United States Patent [19]

Uemura

[11] 4,081,715

[45] Mar. 28, 1978

[54] LUMINESCENT DISPLAY TUBE WITH PLURAL CATHODES AND ELECTRON FLUX DISPERSING MEANS

[75] Inventor: Sashiro Uemura, Watarai; Japan

[73] Assignee: Ise Electronics Corporation, Ise, Japan

[21] Appl. No.: 772,556

[22] Filed: Feb. 28, 1977

[30] Foreign Application Priority Data

Mar. 1, 1976 Japan ..... 51-21928
Mar. 1, 1976 Japan ..... 51-21930

[51] Int. Cl.[2] ..... H01J 63/06; H01J 29/50

[52] U.S. Cl. ..... 315/13 R; 315/167; 315/334; 315/338

[58] Field of Search ..... 315/167, 334, 337, 13 R, 315/339, 338

[56] References Cited

U.S. PATENT DOCUMENTS 3,746,909 7/1973 Runtzel et al. ..... 315/13 R
3,863,163 1/1975 Farrell et al. ..... 315/13 R X

*Primary Examiner*—Alfred E. Smith
*Assistant Examiner*—Charles F. Roberts
*Attorney, Agent, or Firm*—Boone, Schatzel, Hamrick & Knudsen

[57] ABSTRACT

In an electronic device such as a fluorescent display tube which comprises an evacuated envelope, a plurality of cathode electrodes and an anode electrode, auxiliary electrodes are arranged between the cathode electrodes and the anode electrode. Each auxiliary electrode is impressed with AC potential superposed on DC potential and acts to disperse the electron flux emitted by the cathode electrodes in the lateral direction thus uniformly distributing the electron flux on the anode electrode.

8 Claims, 8 Drawing Figures

LUMINESCENT DISPLAY TUBE WITH PLURAL CATHODES AND ELECTRON FLUX DISPERSING MEANS

BACKGROUND OF THE INVENTION

This invention relates to apparatus for evenly distributing an electron flux emitted from cathode electrodes on an anode electrode.

In an electronic device, for example, a flat, fluorescent display tube, electrons emitted from cathode electrodes are caused to impinge upon an anode electrode coated with a phosphor through a character selection grid electrodes to cause the phosphor to luminesce, but as the area of the phorphor film increases, it becomes difficult to evenly discribute the electron flux over the entire area, thus causing dark and bright portions. For this reason, it has been the practice to interpose auxiliary electrodes between the cathode electrodes and the anode electrode, and by using a special construction for the auxiliary electrode or by applying a positive potential upon the auxiliary electrode with respect to the cathode electrode, the electron flux distribution on the anode electrode was improved to some extent. However, these measures are not yet sufficient to perfectly prevent uneven luminescence of the phosphor film.

SUMMARY OF THE INVENTION

It is an object of this invention to provide novel apparatus for evenly distributing the electron flux emitted from cathode electrode on an anode electrode.

Another object of this invention is to provide a fluorescent display device capable of luminescecing with uniform brightness.

According to this invention, there is provided an electronic device of the class comprising an evacuated envelope, a plurality of spaced apart elongated cathode electrodes which are disposed in parallel on the same plane in the envelope for emitting an electron flux, and an anode electrode opposing the cathode electrodes, characterized in that there are provided a plurality of electron flux dispersing members disposed between the cathode electrodes and the anode electrode and extending in the longitudinal direction of the cathode electrodes, and that the electron flux dispersing members are impressed with direct current potential and alternating potential for dispersing the electron flux in the transverse direction of the cathode electrodes, thereby uniformly distributing the electron flux on the anode electrode.

In one embodiment, each electron flux dispersing member comprises an auxiliary electrode impressed with alternating potential superposed on direct current. In another embodiment, the electron dispersing member comprises an auxiliary electrode impressed with DC potential and a magnetic member in parallel with the auxiliary electrode and provided with a coil energized by alternating current.

DESCRIPTION OF THE PREFERRED EMBODIMENTS

Figure 1:
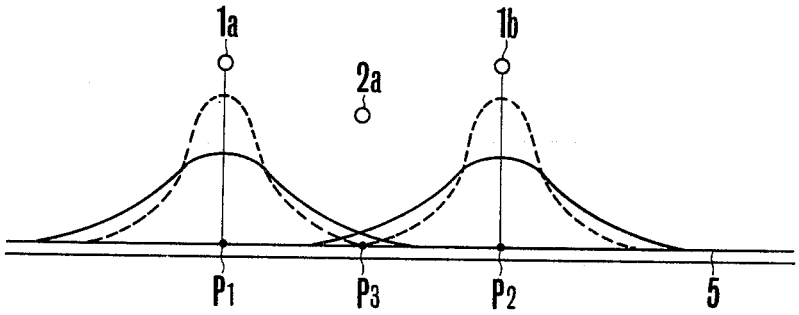
FIG.1 (PRIOR ART)
FIG. 1 is a graph showing the electron flux distribution of a prior art electron beam emitting apparatus.

Before describing the invention, one example of prior art apparatus for evenly distributing an electron flux will be described with reference to FIGS. 1 and 2. Electrons emitted by a plurality of elongated cathode electrodes 1*a* and 1*b* which are disposed in an evacuated envelope, not shown, reach an anode electrode 5. As shown by dotted lines in FIG. 1, the electron flux distribution takes the form of a normal curve having peaks $P_1$, $P_2$ beneath the cathode electrodes 1*a* and 1*b*. At the valley $P_3$ of the curve, luminescence is small. To obviate this difficulty an elongated auxiliary electrode 2*a* was provided between the cathode electrodes 1*a* and 1*b* with a displacement toward the anode 5, and the distribution of the electron flux on the anode electrode was improved by applying a positive potential to the anode electrode 5 from a DC source 20 and a positive potential to the auxiliary electrode from a DC source 21. With this arrangement, electrons emitted by the cathode electrode 1*a*, which is heated by an AC source 22, for example, are also attracted by the auxialiary electrode 2*a* so that the peaks $P_1$ and $P_2$ are flattened. However, as DC potential is impressed upon the auxiliary electrode 2*a*, as shown by solid lines in FIG. 1, there remains a valley corresponding to the valley $P_3$, thus failing to completely solve the problem.

Figure 2:
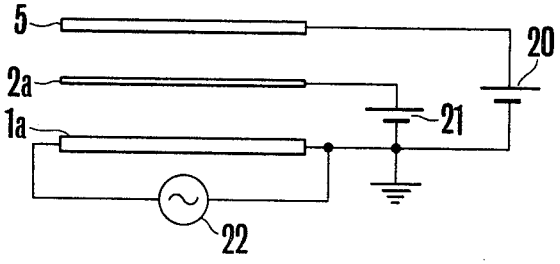
FIG.2 (PRIOR ART)
FIG. 2 is a connection diagram showing one example of a prior art apparatus for evenly distributing an electron flux.
Figure 3:
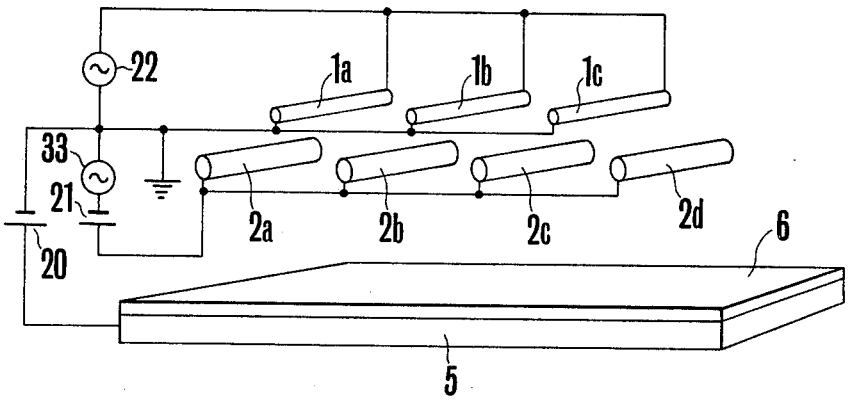
FIG. 3 is a diagrammatic representation of one embodiment of the apparatus for evenly distributing an electron flux of this invention.

FIG. 3 shows one embodiment of this invention as applied to a plain fluorescent display tube in which elements corresponding to those shown in FIGS. 1 and 2 are designated by the same reference numerals. As shown in the figure, there are provided cathode electrodes 1*a*, 1*b* and 1*c*, for example, thermionic cathodes which are energized by an AC source 22 for emitting electrons, auxiliary electrodes 2*a* through 2*d* impressed with DC voltage from a DC source 21 and AC voltage from an AC source 33, and a plate-shaped anode electrode 5 coated with a phosphor film 6.

Both cathode electrodes 1*a*, 1*b* and 1*c*, and auxiliary electrodes are of an elongated rod shape. The cathode electrodes are disposed in parallel spaced-apart relationship in the same plane and the auxiliary electrodes are disposed in a plane displaced from the plane of the cathode electrodes and situated between the cathode electrodes and the anode electrode. The cathode electrodes and the auxiliary electrodes lie in the same axial direction. The cathode electrodes are grounded and the anode electrode 5 is impressed with a positive potential with respect to the ground. Due to the series connection of the DC source 21 and the AC source 33, the voltage impressed upon the auxiliary electrodes varies about the positive voltage with an amplitude of the AC voltage. The envelope containing these electrodes is evacuated to a vacuum on the order of $10^{-6}$ Torr.

The operation of the apparatus described will how be described with reference to FIG. 4.

When a DC voltage of from 25 to 30 volts, for example, is impressed across the cathode electrodes 1*a*, 1*b* and 1*c* and the anode electrode 5 which are spaced apart about 2mm, for example, the cathode electrodes emit electrons. Without the provision of the auxiliary electrodes, the electrons distribute as shown by dotted lines shown in FIG. 1. When an AC voltage, having a peak to peak value of 5 to 10 volts and 50 or 60Hz, for example, is impressed upon the auxiliary electrodes, the electron flux will be scanned over a width of *l* (see FIG. 4). More particularly, at the peak of the AC voltage, portion 5*a* has the highest brightness, portion 5*b* an intermediate brightness and portion 5*c* the lowest brightness. At the next moment, portion 5*a* will have the lowest brightness, portion 5*b* the highest brightness and portion 5*c* an intermediate brightness, and at the following moment, portion 5*a* will have an intermediate brightness, portion 5*b* the lowest brightness and portion 5*c* the highest brightness. In this manner, as the electron flux is scanned across the phosphor film 6 according to the period of the AC voltage impressed upon the auxiliary electrodes 2*a* through 2*d*, the electron flux is distributed uniformly thus causing uniform luminescence of the phosphor film. Of course, the width of the range *l* can be varied by varying the peak value of the AC voltage.

Instead of a fluorescent display tube, the invention is also applicable to other types of electronic display tubes.

Figure 4:
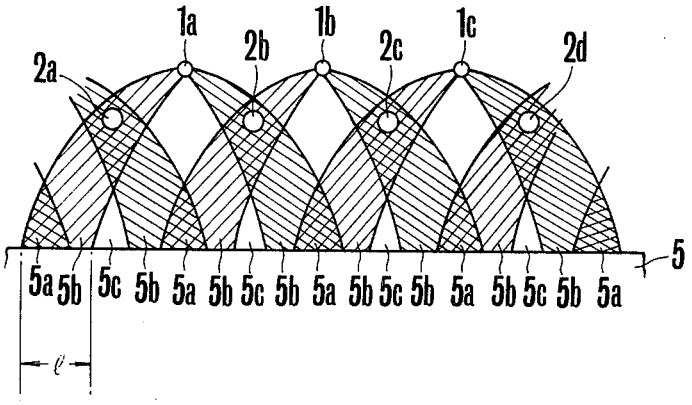
FIG. 4 is a graph showing the distribution of the electron flux on an anode electrode obtained by the apparatus shown in FIG. 3.
Figure 5:
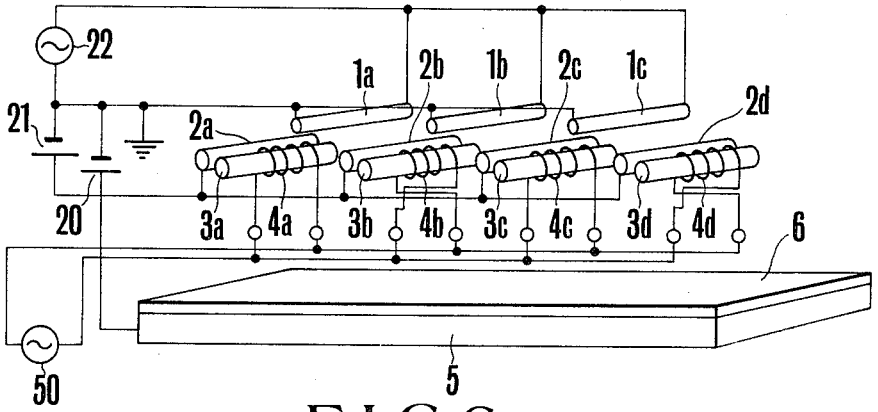
FIG. 5 is a diagrammatic representation of a modification of this invention.

FIG. 5 shows another embodiment of this invention in which elements corresponding to those shown in FIG. 3 are designated by the same reference numerals. In this embodiment, the auxiliary electrodes are impressed with a predetermined DC voltage. Elongated magnetic members 3*a* to 3*d* are disposed in parallel and closely adjacent to auxiliary electrodes 2*a* to 2*d*, respectively, and coils 4*a* through 4*d* are respectively wound on magnetic members 3*a* to 3*d* and energized by an AC source 50. Adjacent coils are wound in the opposite direction to have the opposite polarities. For example, the coils 4*b* and 4*d* have the opposite polarity to the coils 4*a* and 4*c*. Accordingly, the electric field produced by the auxiliary electrodes drives electrons toward the auxiliary electrodes 2*a* through 2*d*. Since the coils 4*a* through 4*d* are energized by alternating current, the electrons are swung in the lateral direction with the result that they are scanned in a range *l* (see FIG. 4) over the phosphor film 6. Thus the auxiliary electrodes and the magnetic members cooperate to disperse the electrons.

Figure 6:
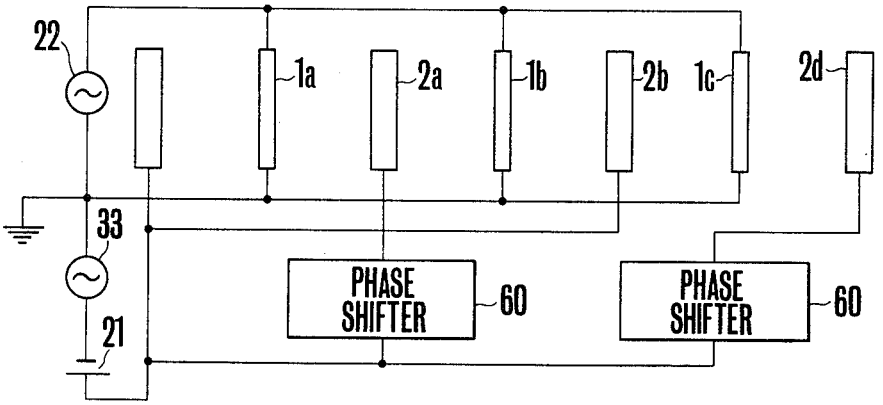
FIGS. 6 and 7 are block diagrams each showing another embodiment of this invention.
Figure 7:
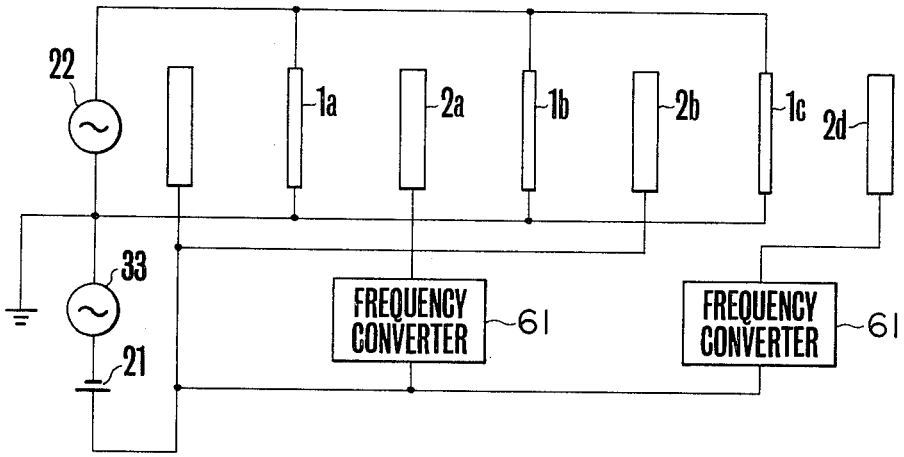

In the foregoing embodiments, since the auxiliary electrodes or the coils 4*a* through 4*d* of the magnetic members are supplied in the same phase with AC voltage, the electrons emitted by a cathode electrode, for example 1*a* are distributed symmetrically as shown in FIG. 4 by the auxiliary electrodes 2*a* and 2*b* or magnetic members 4*a* and 4*b*. In still another modification shown in FIG. 6, AC voltage is applied to alternate auxiliary electrodes or coils through phase shifters 60 for applying AC voltages of different phase to adjacent auxiliary electrodes or coils thereby asymmetrically distributing the electron flux. In another modification shown in FIG. 7, frequency converters 61 are substituted for the phase shifters for applying AC voltages of different frequency to adjacent auxiliary electrodes or coils. According to the embodiments shown in FIGS. 6 and 7, it is possible to intentionally increase or decrease the electron density impinging on a portion of the anode electrode thus changing the brightness at that portion.

Figure 8:
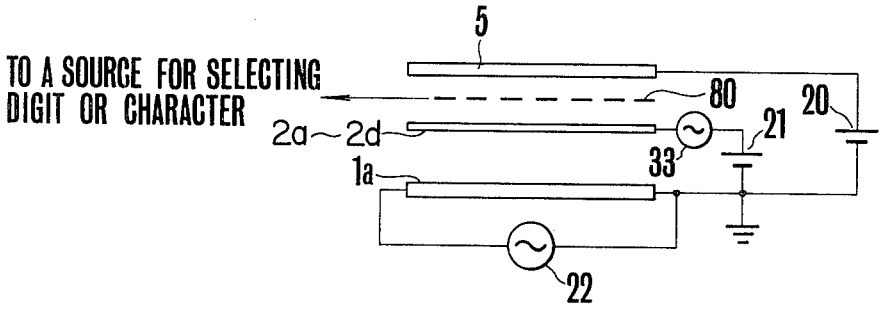
FIG. 8 is a connection diagram showing still another embodiment of this invention.

In an actual fluorescent display device illustrated in FIG. 8, a grid electrode 80 connected to a digit or character selection source, not shown, is provided between the anode electrode 5 and the auxiliary electrodes 2*a* to 2*d*. As above described, it is sufficient to apply an electrical potential to the axuiliary electrodes and is not necessary to pass an electrical current therethrough. Rather, it is advantageous to cover the auxiliary electrodes with an electrical insulator to prevent the current from flowing through them due to electrons emitted by the cathode electrode.

In the above-described embodiments, the phosphor films were shown as flat but they may be curved. Furthermore, the cathode electrodes and the auxiliary electrodes may be disposed on the same plane.

As above described, according to this invention it is possible to evenly distribute electrons on a phosphor plane or a character or digit selection grid. Especially in the former case, it is possible to cause the phosphor film to uniformly luminesce. If desired, it is possible to vary the brightness of a portion of the phosphor film, thus increasing the variety of the display. For the same brightness of the fluorescent film, it is possible to increase the spacing between the cathode electrodes, thus saving the power.

Whereas the present invention has been described above by making reference to particular embodiments shown in the drawing, it is to be understood that such embodiments are intended to be illustrative rather than limiting, and it is contemplated that many alterations and modifications could be made without departing the merits of the invention. Accordingly, it is intended that the appended claims be interpreted as covering all such alterations and modifications as fall within the true spirit and scope of the invention.

What is claimed is:

1. In an electronic device of the type comprising an evacuated envelope, a plurality of spaced apart elongated cathode electrodes which are disposed in parallel in the same place in said envelope for emitting an electron flux, and an anode electrode opposing said cathode electrodes, the improvement which comprises a plurality of electron flux dispersing members disposed between said cathode electrodes and said anode electrode and extending in the longitudinal direction of said cathode electrodes, and means for impressing direct current potential and alternating current potential upon said electron flux dispersing members for dispersing said electron flux in the transverse direction of said cathode electrodes thereby uniformly distributing said electron flux on said anode electrode.

2. The electronic device according to claim 1 wherein electron flux dispersing members are impressed with a predetermined DC potential and an AC potential in phase.

3. The electronic device according to claim 1 wherein adjacent electron flux dispersing members are impressed with a predetermined DC potential and AC potentials of different phases.

4. The electronic device according to claim 1 wherein adjacent electron flux dispersing members are impressed with a predetermined DC potential and AC potentials of different frequencies.

5. The electronic device according to claim 1 wherein each electron flux dispersing member comprises an elongated auxiliary electrode impressed with alternating potential superposed on direct current potential.

6. The electronic device according to claim 1 wherein each electron flux dispersing member comprises an auxiliary electrode applied with a predetermined DC potential, a magnetic member disposed closely adjacent and in parallel with the auxiliary electrode, and a coil wound about the magnetic member and energized by an alternating current, the coils of adjacent magnetic members being wound in the opposite direction.

7. The electronic device according to claim 1 which further comprises a grid electrode disposed between the anode electrode and the electron flux dispersing members, and said anode is coated with a luminescent film.

8. The electronic device according to claim 5 wherein each elongated auxiliary electrode is covered with an electrical insulator.

* * * * *